US005378221A

United States Patent [19]

Lauderbaugh et al.

[11] Patent Number: 5,378,221

[45] Date of Patent: Jan. 3, 1995

[54] ASSEMBLY AND METHOD FOR AXIALLY ALIGNING SLOTTING, TRIMMING, SCORING OR LIKE HEADS

[75] Inventors: David Lauderbaugh, Roswell; Gene A. Jenkins, Woodstock, both of Ga.

[73] Assignee: Corrugated Gear & Sprocket, Inc., Alpharetta, Ga.

[21] Appl. No.: 965,799

[22] Filed: Oct. 23, 1992

[51] Int. Cl.[6] ..... B21B 1/14

[52] U.S. Cl. ..... 493/367; 493/354; 493/365; 493/370; 493/402; 493/471; 83/508.3; 83/499; 83/504

[58] Field of Search ..... 493/402, 403, 354, 370, 493/471, 475, 367, 368, 365, 366; 83/425.4, 508.3, 499, 824, 504

[56] References Cited

U.S. PATENT DOCUMENTS

| | | | |
|---|---|---|---|
| 4,926,730 | 5/1990 | Garrett | 83/499 |
| 5,057,068 | 10/1991 | Capdeboscq | 493/367 |
| 5,123,891 | 6/1992 | Nieradka et al. | 493/475 |
| 5,158,525 | 10/1992 | Nikkel | 493/370 |

*Primary Examiner*—Bruce M. Kisliuk
*Assistant Examiner*—Eileen P. Morgan
*Attorney, Agent, or Firm*—Jones & Askew

[57] ABSTRACT

A device and method for axially aligning a rotary head assembly. The rotary head assembly includes a rotary head and an axial alignment assembly. The axial alignment assembly includes a guide plate means fixed to the rotary head. The guide plate means has a pair of opposing surfaces extending radially from the shaft. The axial alignment assembly also includes a carrier means with a yoke attached thereto, and an alignment element attached to the yoke. The alignment element has a pair of opposing wear surfaces for contact with the opposing surfaces of the guide plate means. The alignment element also includes an axial pressure exerting means for exerting pressure axially on each wear surface so that there is contact between the opposing surfaces of the guide plate means and the corresponding wear surfaces. Pressure is exerted on the wear surface in the direction toward the corresponding face of the guide plate means to maintain axial alignment of the head assembly as it rotates.

24 Claims, 9 Drawing Sheets

ASSEMBLY AND METHOD FOR AXIALLY ALIGNING SLOTTING, TRIMMING, SCORING OR LIKE HEADS

TECHNICAL FIELD

This invention relates to an alignment assembly and method for rotary slotting, trimming, scoring, and like heads (hereinafter referred to collectively as "rotary heads"). In particular, the present invention is directed to an alignment assembly and method for axially aligning rotary heads used in the formation of cardboard blanks.

BACKGROUND OF THE INVENTION

Rotary heads are used in manufacturing of cardboard boxes, cartons, cases and the like from sheets of cardboard. In the manufacture of cardboard boxes, the cardboard sheets are cut by trimming heads, slotted by slotting heads, and creased by scoring heads to form a blank. Ben the blank is folded, it forms a box, carton or case.

A rotary head assembly includes a pair of rotary heads (upper and lower) mounted on horizontally oriented rotatable shafts for trimming, slotting and scoring the cardboard and an axial alignment assembly for keeping the rotary heads in axial alignment. The cardboard moves through the space between the pairs of corresponding upper and lower rotary heads. In order to accurately trim, slot, or score the cardboard, the male blades of the rotary head must be perfectly aligned with the female recesses provided in the corresponding rotary head. If the male blade and female recess of the rotary heads are not aligned, the blades could hit other parts of the head and cause damage to the blade and to other parts of the head assembly as well as mutilate the cardboard sheet. Thus, axial alignment of the rotary heads for trimming, slotting, and scoring is a critical part of the cardboard blank forming operation.

When the size or shape of blanks changes, the rotary heads must be moved along their respective axes and aligned to accommodate such changes. The axial alignment assembly moves the rotary heads to the appropriate position and aligns the corresponding heads. The axial alignment assembly includes a motorized carriers mounted on corresponding parallel shafts, away from the area through which the cardboard is fed. For example, the upper rotary heads, located above the cardboard feed area, have their respective carriers and carrier shafts located above them while the lower rotary heads have their respective carriers and carrier shafts located below them. The axial alignment assembly also includes a yoke connected to the carrier. The yoke has outwardly extending arms. The arms extend on either side of the rotary, head shaft. The axial alignment assembly also includes guide plates fixed to the rotary heads and wear pads on at least one yoke arm for bearing against the guide plates which rotate with the rotary heads.

When the carrier moves axially along its shaft, the yoke and yoke arms engage the rotary head and move the rotary head axially. Once the carrier has moved the rotary head to the desired location, the carrier stops and thus locks the rotary head in a horizontal position. Once the upper and lower corresponding heads have been axially aligned relative to one another, it is critical that this alignment be maintained while the heads rotate during operation.

Axial alignment of the heads is at present accomplished by the use of rectangular metal wear pads mounted to the yoke arms. The wear pads contact the spaced-apart metal guide plates. As the head rotates, the spaced apart plates rotate and rub against the wear pads. The metal-to-metal contact between the guide plates and the wear pads causes accelerated wear in the wear pads and thus requires frequent replacement of the wear pads. Replacement of the wear pads is time consuming and costly because the entire axial alignment assembly must be disassembled in order to access the wear pads located between the yoke and the guide plates. When the wear pads are replaced, the upper and corresponding lower heads must be realigned as a result of changes in thickness of the wear pad. As a result of the present alignment system, cardboard manufacturers incur considerable time to complete the replacement and realignment procedure and expense in labor costs and machinery down time.

An alternative axial alignment system for rotary heads is disclosed in U.S. Pat. No. 4,926,730 issued to Garrett. The invention is directed to a yoke having a series of holes axially bored through the yoke arms. Roller bearings are mounted in the holes. The roller bearings have a diameter greater than the yoke thickness to insure contact with the head plates. During operation, the roller bearings perform the same function as the wear pads described above and rub against the guide plates as the guide plates rotate with the head. As the roller bearings begin to wear, they must be manually adjusted to maintain the desired alignment of the rotary heads. Manual adjustment of the roller bearings requires shutting down the machinery and separating the yoke from the guide plates attached to the rotary head. Similarly as with the replacement of the wear pads described above, replacement or adjustment of the roller bearings disclosed in Garrett is time consuming and costly to the cardboard blank manufacturer. Moreover, once the rollers in Garrett are adjusted or replaced, the upper and lower heads must be realigned. This additional step increases the time and cost of an already time consuming and costly alignment procedure.

In view of the axial alignment assemblies and methods at present available for axially aligning rotary heads, there is a need for an axial alignment assembly and method for aligning such rotary heads inexpensively.

There is a further need for an axial alignment assembly for rotary heads that is inexpensive to manufacture.

There is yet further need for an axial alignment assembly for rotary heads that requires little time to install or replace.

There is still a further need for an axial alignment assembly for rotary heads that is self-aligning.

There is a yet another need for an axial alignment assembly for rotary heads that may be used in existing head as assemblies.

There is still another need for an axial alignment assembly for rotary heads that may be made primarily of a self-lubricating material.

There is still yet a further need for a method of axially aligning, rotary heads that takes less time to install than present methods.

SUMMARY OF THE INVENTION

As will be seen, the present invention overcomes these and other disadvantages associated with prior art rotary head alignment devices and methods. Stated generally, the present invention comprises an axial alignment assembly for axially aligning rotary heads of a rotary head assembly. The axial alignment assembly includes a yoke attached to a carrier for axial movement, guide plate means fixed to the rotary head, and an alignment element attached to the yoke for engaging the guide plate means.

In one embodiment, the guide plate means has a pair of opposing surfaces that extend radially from the shaft of the rotary head. The alignment element is wedge-shaped and is attached to the yoke by means of a spring loaded bolt. The alignment wedge has a matching pair of opposing wear surfaces for contact with the surfaces of the guide plate means. The surfaces of the guide plate means and the wear surfaces of the alignment wedge have mating profiles. The spring loaded bolt serves to urge the wedge shaped alignment element radially toward the shaft so that the wear surfaces of the alignment element are kept in contact with the guide plate means even as the alignment element wears.

In a second embodiment of the present invention, the guide plate means extends radially without a taper. The alignment element includes wear pads mounted in holes in the yoke arms and a wedge insert received into a similarly shaped recess within the yoke. The wedge insert is connected to the yoke by spring loaded bolts. The spring loaded bolts urge the wedge radially which in turn exerts a continuous axial pressure forcing the wear pads out of the holes toward the mating surfaces of the guide plate means.

Thus, it is an object of the present invention to provide an axial alignment assembly and method for inexpensively and quickly axially aligning rotary heads.

It is a further object of the present invention to provide an axial alignment assembly for axially aligning rotary heads that is inexpensive to manufacture.

It is yet a further object of the present invention to provide an axial alignment assembly for axially aligning rotary heads that continuously aligns itself.

It is even yet a further object of the present invention to provide an axial alignment assembly for axially aligning rotary heads that may be used in existing rotary head assemblies.

It is still another object of the present invention to provide an axial alignment assembly for axially aligning rotary heads that is made primarily of a self-lubricating material.

It is yet another object of the present invention to provide a method for axially aligning rotary heads that takes less time than present methods.

Other objects, features and advantages of the present invention will be apparent upon reading the following specification taken in conjunction with the drawings and appended claims.

DETAILED DESCRIPTION OF THE INVENTION

Structure of the Invention

Figure 1:
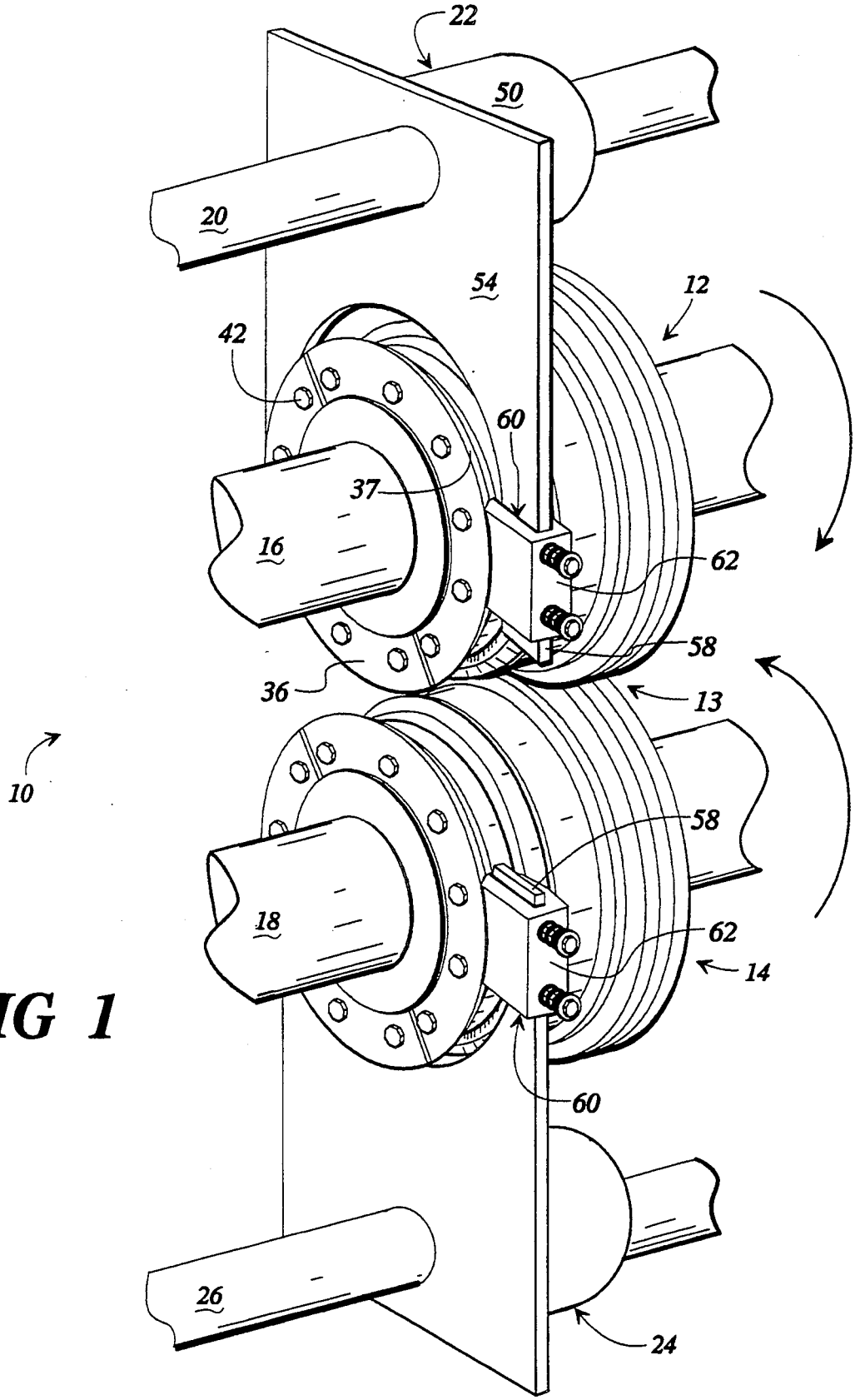
FIG. 1 is an overall perspective view of a rotary head assembly which is part of a cardboard blank formation machine.

Referring now to the drawings, in which like numerals indicated like elements throughout the several views, FIG. 1 discloses a perspective view of a portion of a cardboard blank formation assembly 10. The assembly 10 includes upper and lower rotary head assemblies 12,14 respectively. The upper rotary head assembly 12 is mounted on a rotatable upper shaft 16. Similarly, the lower rotary head assembly 14 is mounted on a rotatable lower shaft 18. An upper carrier shaft 20 is located parallel to and above the upper shaft 16. An upper carrier assembly 22 is slidably mounted on the upper carrier shaft 20. Similarly, a lower carrier assembly 24 is mounted on a lower carrier shaft 26 which is located parallel and below the lower shaft 18.

Figure 2:
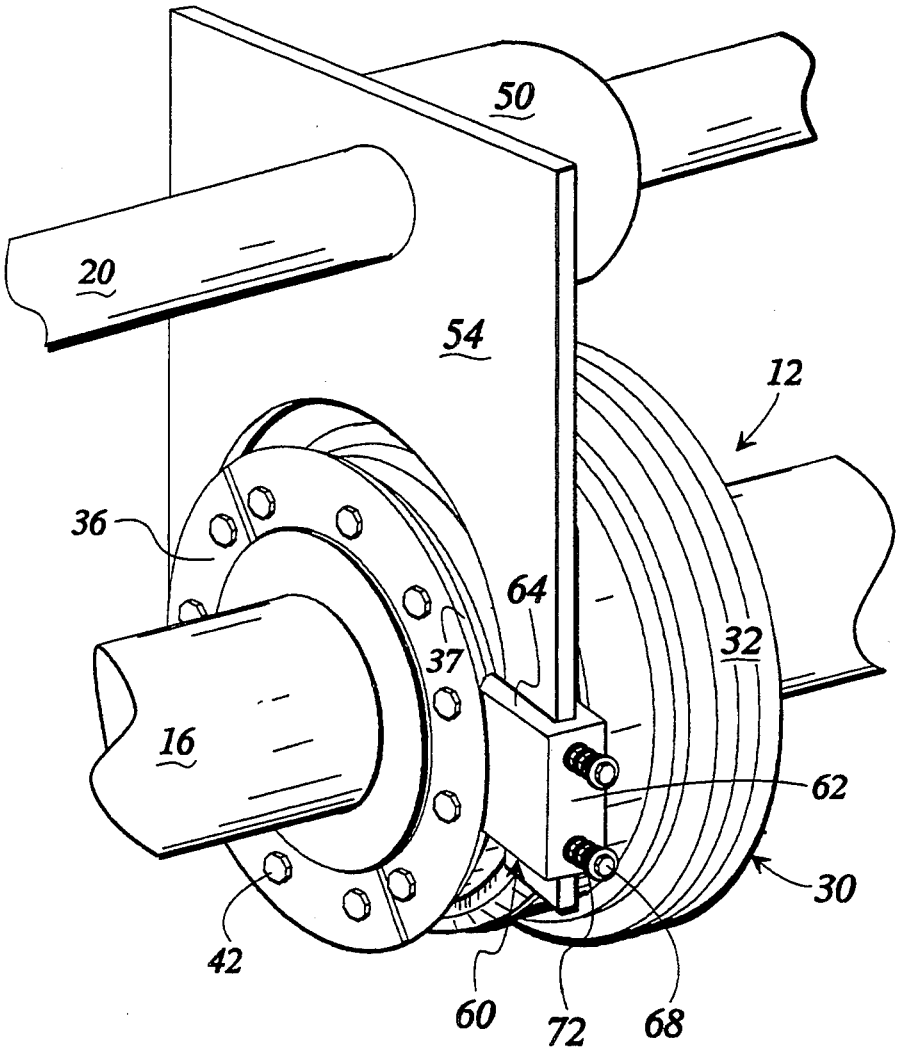
FIG. 2 is a perspective view of an upper rotary head assembly.
Figure 3:
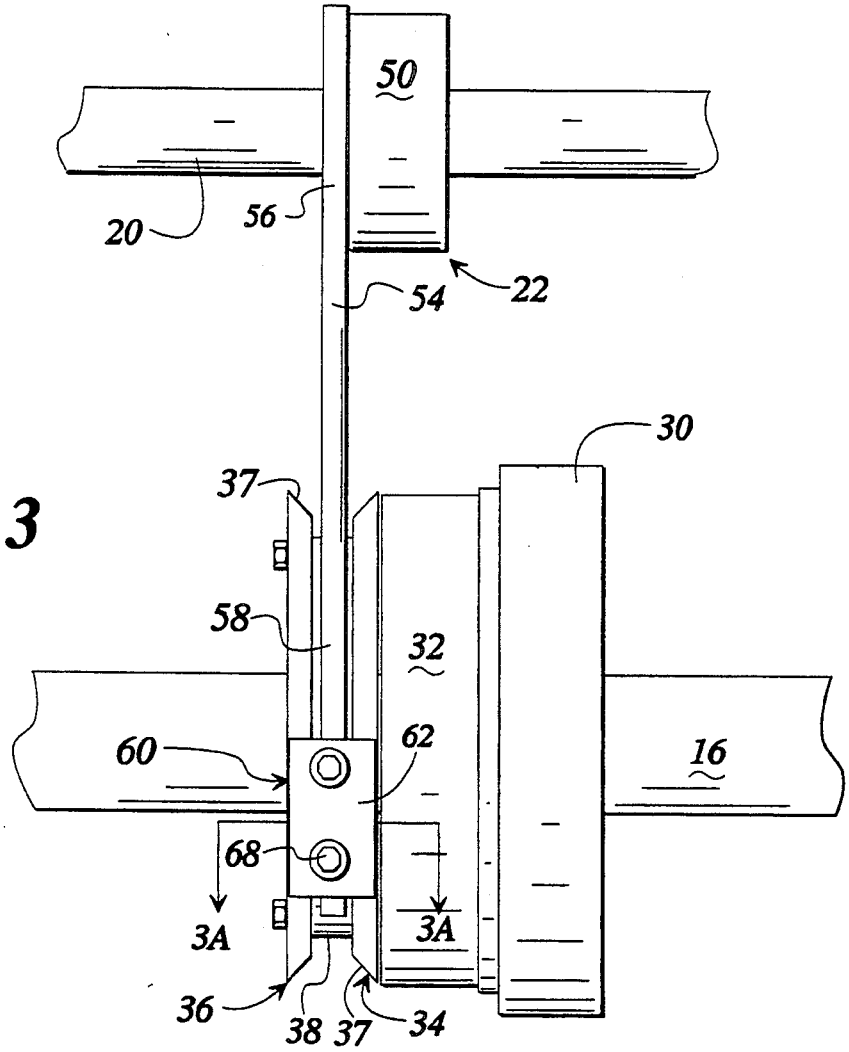
FIG. 3 is a side view of the upper rotary head assembly shown in FIG. 2.
Figure 4:
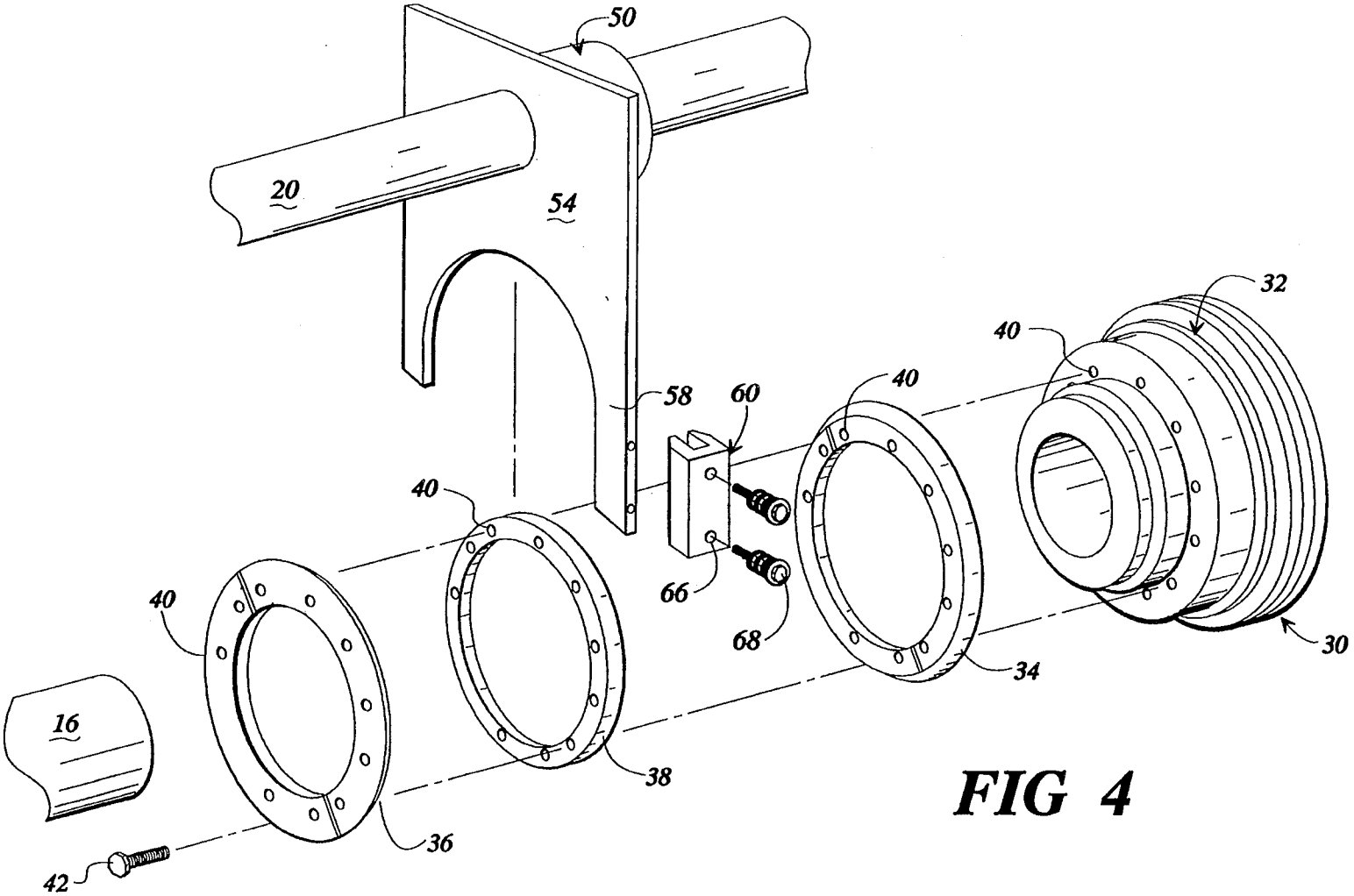
FIG. 4 is an exploded view of the upper rotary head assembly shown in FIG. 2.
Figure 5:
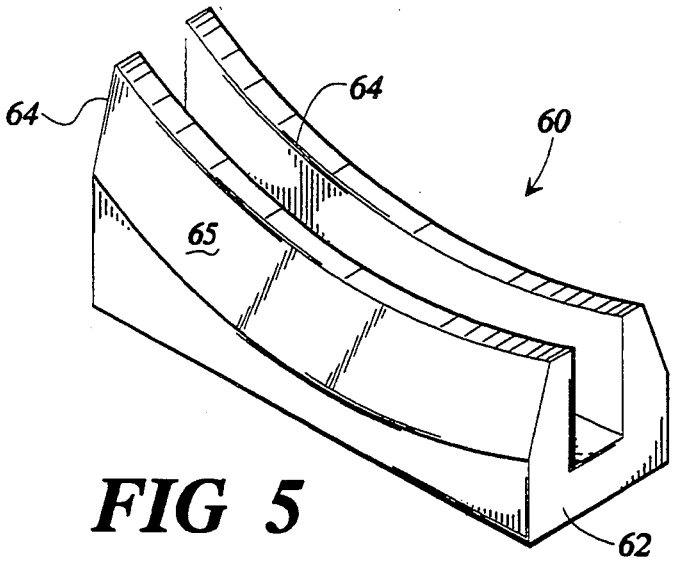
FIG. 5 is a perspective view of the preferred embodiment of the alignment element (wedge) of the present invention.

Turning now in more detail to the upper rotary head assembly 12, FIG. 2 shows a perspective view of the upper rotary head assembly. The upper rotary head assembly 12 includes an upper rotary head 30 for slotting, trimming, scoring or the like. The rotary head has a body 32 which is substantially cylindrical in shape. A first guide plate 34, shown in FIG. 3, is located immediately adjacent to one end of the body 32. The first guide plate 34 is coaxially mounted on the upper shaft 16. A second guide plate 36 is spaced apart from the first guide plate 34 by means of a spacer 38. The second guide plate 36 is coaxially mounted on the shaft 16. The guide plates 34,36 are circular in cross section and taper radially outward to form opposing guide plate faces 37. The diameter of the first and second guide plates 34,36 is greater than that of the spacer 38 to create a circumferential recess between the first and second guide plates. FIG. 4 is an exploded view of the upper rotary head assembly 30. The upper rotary head body 32, first guide plate 34, spacer 38 and second guide plate 36 have corresponding holes 40 through which bolts 42 fit to secure the first guide plate, spacer and second guide plate to one end of the upper rotary head 30.

Figure 3A:
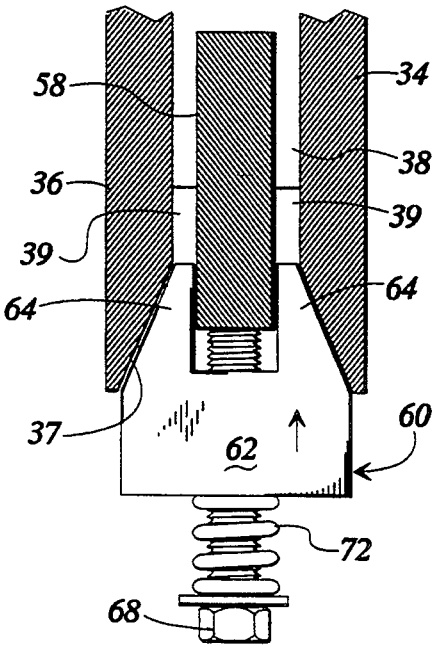
FIG. 3A is a cross-sectional view of a portion of the upper rotary head assembly shown in FIG. 3.

Returning to FIG. 3, the upper carrier assembly 22 includes an upper carrier 50 which houses an upper carrier motor (not shown) and a yoke 54. The carrier 50 and yoke 54 are slidably mounted on the upper carrier shaft 20. The yoke 54 has a base section 56 and yoke arms 58 that extend downwardly into the recess formed by the spacer 38 between the first and second guide plates 34,36. The thickness of the spacer 38 is sufficiently greater than that of the yoke arms 58 so that gaps exists between the guide plates 34,36 and yoke arm 58, as shown in FIG. 3A.

Figure 6:
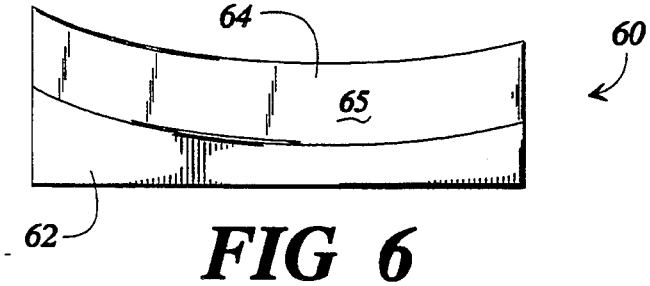
FIG. 6 is a side view of the alignment element (wedge) of FIG. 5.

In a first preferred embodiment, where space surrounding the rotary head assembly is not a concern, an axial alignment element 60 is secured to the yoke arm 58. The alignment element 60, as best shown in FIGS. 5–8, includes a base 62 and a pair of parallel, outwardly extending members 64. The members 64 have tapered surfaces 65 that correspond to the tapered guide plate faces 37. A side view of the alignment element 60, as shown in FIG. 6, shows that the base 62 and members 64 curve. This shape enables the tapered surfaces 65 of the alignment element 60 to correspond with a greater area of the corresponding guide plate faces 37.

Figure 7:
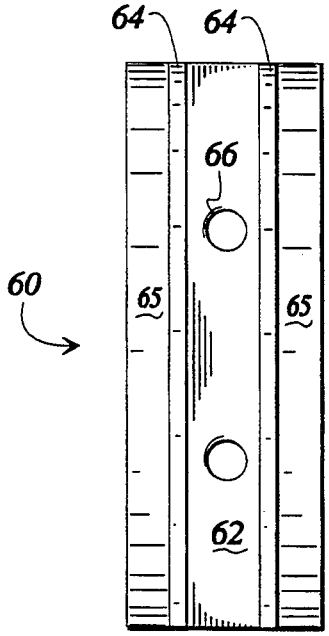
FIG. 7 is a plan view of the alignment element (wedge) of FIG. 5.
Figure 8:
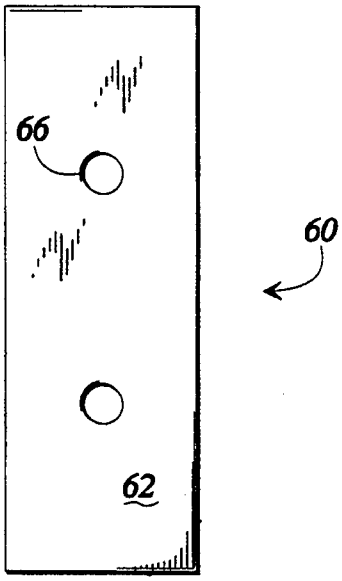
FIG. 8 is a bottom view of the alignment element (wedge) of FIG. 5.

The base 62 has base holes 66 drilled therethrough as shown in FIGS. 7 and 8. The base holes 66 receive alignment bolts 68 shown in FIGS. 3 and 3A. Resting between the shoulder of the alignment bolt 68 and the base 62 is a spring 72. The spring 72 exerts a force extending radially inward toward the upper shaft 16 as shown by arrow 74.

Operation of the Invention

Before a cardboard blank passes through the blank forming equipment, the slotting, trimming, scoring or like heads must be moved along their respective axes to accommodate the particular size and shape of the blank to be formed. The position of the upper rotary head assembly 12 may be seen with respect to the lower head assembly in FIG. 1. To position the upper rotary head assembly 12, the upper carrier motor 52 is energized to axially move the upper carrier 50 and yoke 52 along the upper carrier shaft 20. The axial movement of the yoke 52 causes the upper rotary head assembly 12 to move axially to the desired location along the upper shaft 18. Once the upper rotary head assembly 12 is moved to the desired location, the upper carrier motor 52 is shut off and the upper rotary head assembly 12 is fixed in position. The lower rotary head assembly 14 is moved axially along the lower shaft 18 in a similar manner to that of the upper rotary head assembly 12 discussed above.

The alignment of the upper and lower rotary head and assemblies 12,14 is critical to the proper operation of the machinery. If the male scoring, trimming, or slotting blade in the upper rotary head (not shown) is not properly aligned to be received by the female recess in the corresponding lower head (not shown), the blade could damage itself and the heads during operation. Moreover, improperly aligned heads cause the blades to inaccurately cut the cardboard which results in poor quality blanks.

Once the upper and lower rotary head assemblies 12,14 are aligned with respect to one another, the cardboard sheets are ready to be fed into the space between the upper and lower rotary heads as indicated by arrow 13 shown in FIG. 1. The upper and lower heads turn at the same speed but in contra-rotating fashion with respect to one another which helps feed the cardboard sheets through the space.

As the upper rotary head 30 rotates on the upper shaft 16, the first and second guide plates 34,36 and spacer 38, which are secured to the upper rotary head 30 also rotate. As the cardboard passes beneath the upper rotary head 30, the cardboard exerts axial forces against the upper rotary head assembly 12. These axial forces are transferred to the first and second guide plates 34,36 and to the outwardly extending members 64 of the alignment element 60 as shown in FIG. 3A. The axial position of the upper rotary head 30 is maintained when one of the guide plate faces 37 bears against one of the tapered surfaces 65 of the outwardly extending members 64 as a result of axial pressure against the upper rotary head 30. Because the alignment element 60 is spring loaded to the yoke 54, the tapered surfaces 65 of the outwardly extending members 64 of the alignment element 60 exert axial pressure on the tapered guide plate face 37 to maintain alignment of the upper rotary head 30. The alignment element 60 is preferably made of a self-lubricating material, such as nylatron. Thus, when the guide plate faces 37, usually made of metal, bear against the tapered surfaces 65 of the outwardly extending members 64, the wear is taken by the tapered surface 65 and that wear is minimized as a result of the self-lubricating composition of the alignment element 60.

Figure 9:
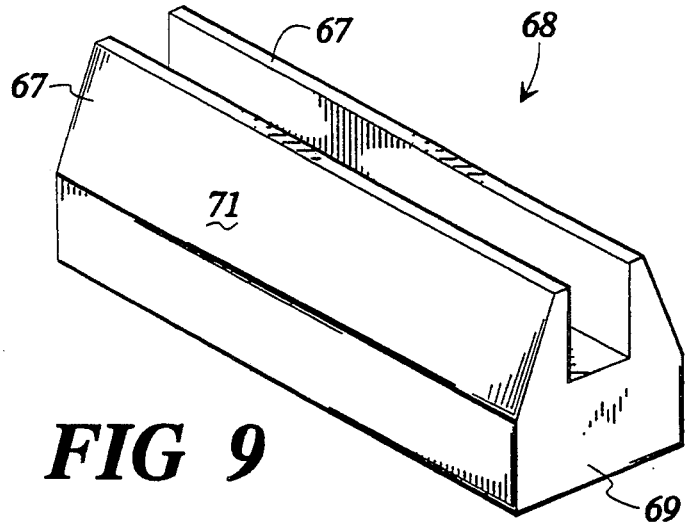
FIG. 9 is an alternative embodiment of the alignment element (wedge) disclosed in FIG. 5.
Figure 10:
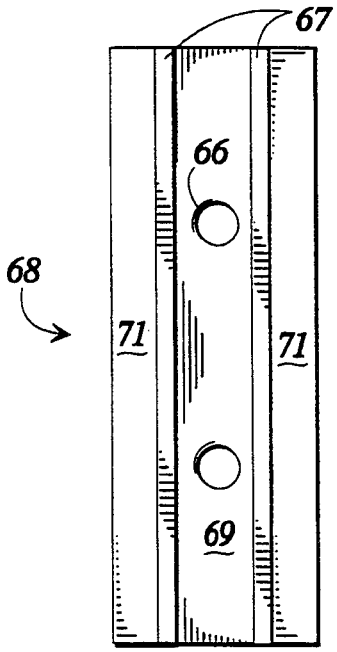
FIG. 10 is a plan view of the alignment element (wedge) of FIG. 9.
Figure 11:
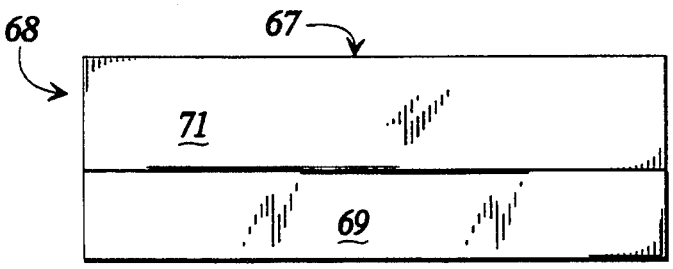
FIG. 11 is a side view of the alignment element (wedge) of FIG. 9.

The curved shape of the outwardly extending member 64 provides an increased surface area for additional contact with the guide plate faces 37. A flat alignment element is shown in FIGS. 9 through 11. The flat alignment element 68 has a base 69, flat, protruding members 67 and flat tapered surfaces 71.

AN ALTERNATIVE EMBODIMENT

In situations where the cardboard forming equipment is fitted closely together, the use of the alignment element 60 described above may be impossible or impractical. Thus, a second alignment element 70 has been designed to be used where rotary head assemblies are in close proximity to one another and where there is no clearance to install the alignment element 60 described above.

Figure 12:
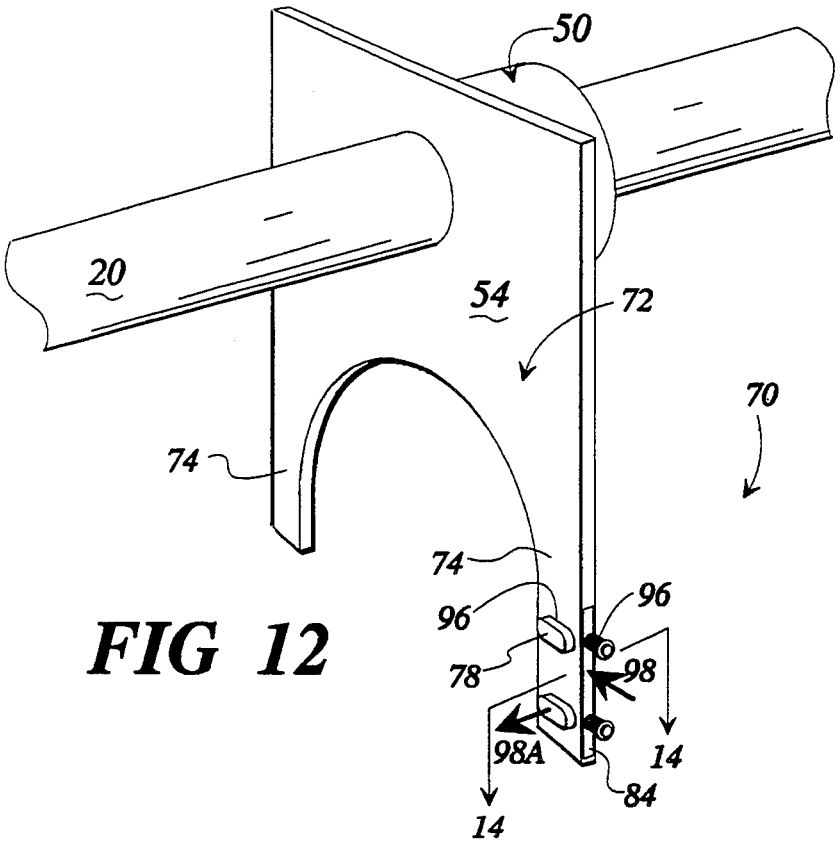
FIG. 12 is a perspective view of yet another alternative embodiment of the yoke and alignment element (pad and wedge insert) of the present invention.
Figure 13:
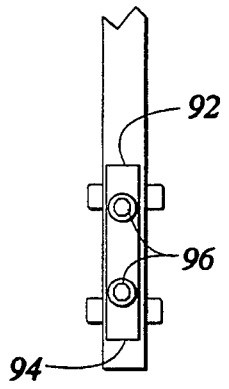
FIG. 13 is a side view of the yoke and alignment element (pad and wedge insert) disclosed in FIG. 12.
Figure 12A:
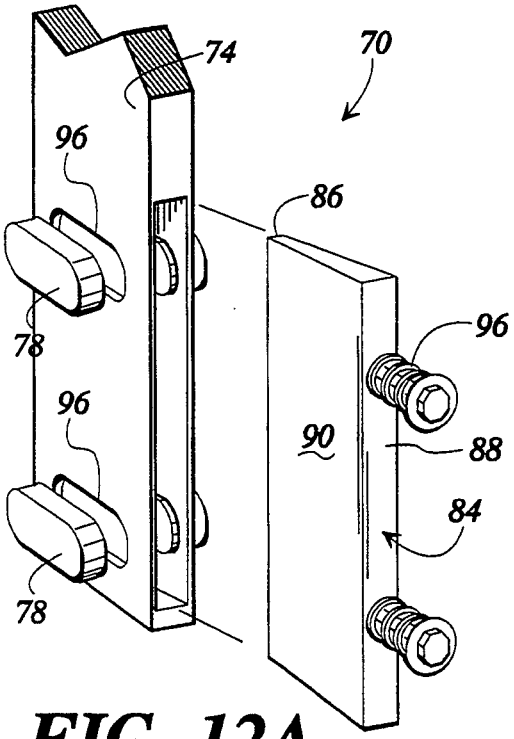
FIG. 12A is a perspective view of a portion of the yoke and alignment element (pad and wedge insert) shown in FIG. 12.
Figure 14:
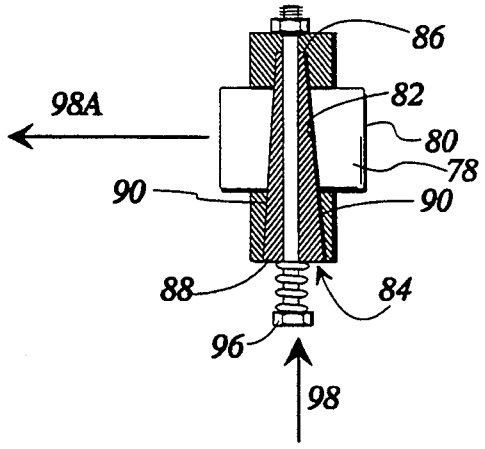
FIG. 14 is a cross-sectional view of the yoke and alignment element (p, ad and wedge insert) of FIG. 12.
Figure 15:
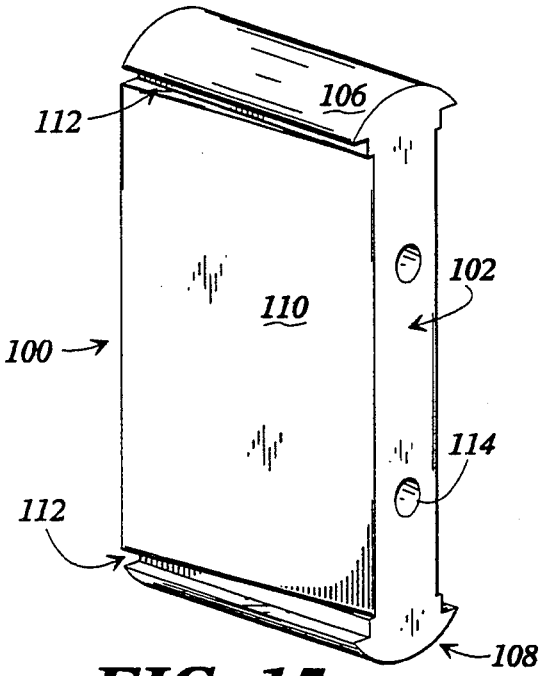
FIG. 15 is a perspective view of an alternative embodiment of the alignment element (wedge insert-pads not shown) disclosed in FIG. 12.
Figure 16:
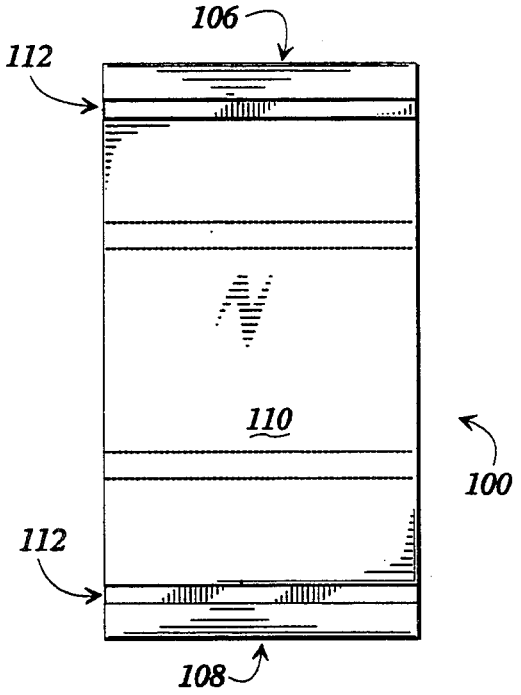
FIG. 16 is a side view of the alignment element (wedge insert-pads not shown) of FIG. 15.
Figure 17:
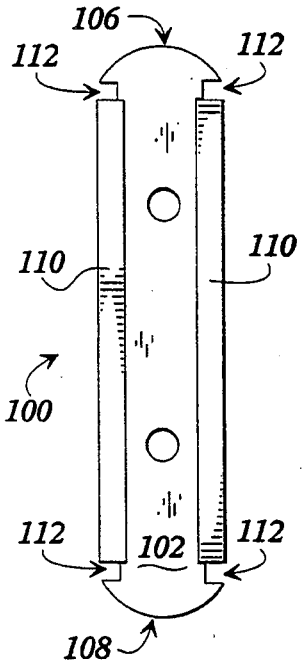
FIG. 17 is a front view of the alignment element (wedge insert-pads not shown) of FIG. 15.
Figure 18:
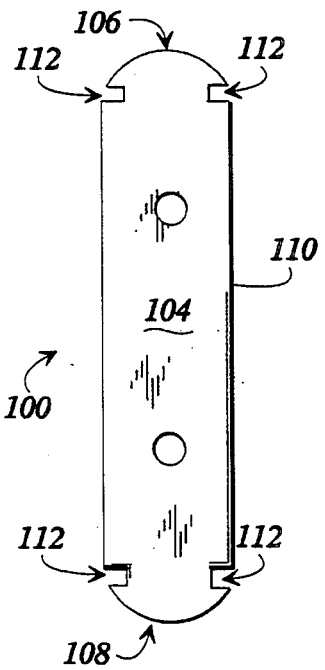
FIG. 18 is a rear view of the alignment element (wedge insert-pads not shown) of FIG. 15.
Figure 19:
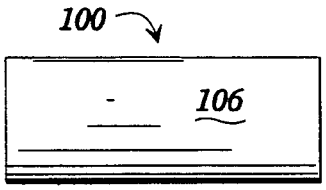
FIG. 19 is a plan view of the alignment element (wedge insert-pads not shown) of FIG. 15.

FIGS. 12 through 14 show the a first alternative alignment assembly 70 which includes a modified yoke 72 which may be made by machining the existing yoke 54 or by making a new one. The modified yoke 72 has downwardly extending modified yoke arms 74. A series of oblong holes 76 are cut through the face of the modified yoke arms 74. The oblong holes 76 are aligned vertically on the modified yoke arms 74. Oblong wear pads 78 fit snugly into the oblong holes 76. The wear pads 78 have an outer flat surface 80 and an inner angled surface 82 as shown in FIG. 14. A wedge insert 84 is received into a wedge-shaped recess 85 located on the side of the modified yoke arm 74, as best shown in FIGS. 13 and 14. The wedge insert 84 has a narrow rectangular front surface 86, a wider, rectangular, rear surface 88, flat side surfaces 90, a flat top surface 92 and a flat bottom surface 94. The side surfaces 90 are angled from the front surface to the rear surface. FIG. 14 shows the side surfaces 90 of the wedge insert 84 contacting the angled inner angled surfaces 82 of the wear pads 78. The wedge insert 84 is secured to the modified yoke arm 74 by a spring loaded bolt 96 which pushes the wedge insert 84 radially inward as indicated by arrow 98 shown in FIGS. 12 and 14. The radially inward force on the wedge insert 84 in turn exerts axial pressure on the wear pads 78 in an outwardly direction toward the flat plug surface 80 of the wear pads 78, as shown by arrow 98A.

The operation of the alternative alignment assembly is similar in some respects to that described above for the first embodiment. The first and second guide plates 34,36, the spacer 38 and the upper rotary head 30 rotate as the cardboard sheet is fed through the space provided between the upper and lower rotary head assemblies 12,14. The modified yoke 72, modified yoke arms 74 and wear pads 78 remain stationary between the faces 37 of the first ,and second guide plates 34,36. A portion of the inward radial pressure exerted on the spring loaded wedge insert 84 is transferred axially to each pad 78 by virtue of the angled inner surface 82 of the wear pads. The axial pressure on the wear pads 78 is directed outward toward the flat surface 80 of the wear pads. The outer flat surface 80 of the wear pads 78 in turn exerts axial pressure on the guide plate faces 37 to maintain axial alignment of the upper rotary head assembly 12.

A grooved wedge insert 100, shown in detail in FIGS. 15 through 19, may be used in lieu of the wedge insert 84 discussed above. The grooved wedge insert 100 has a narrow front surface 102 and a wider rear surface 104. The grooved wedge insert 100 also has arched top and bottom surfaces 106 and 108 respectively. Side surfaces 110 of the grooved wedge insert 100 are angled from the narrow front surface 102 to the wider, rear surface 104. Channeled grooves 112 extend along the top and bottom edges of the side surfaces 110 where the arched top and bottom surfaces 106,108 meet the side surface 110.

Figure 20:
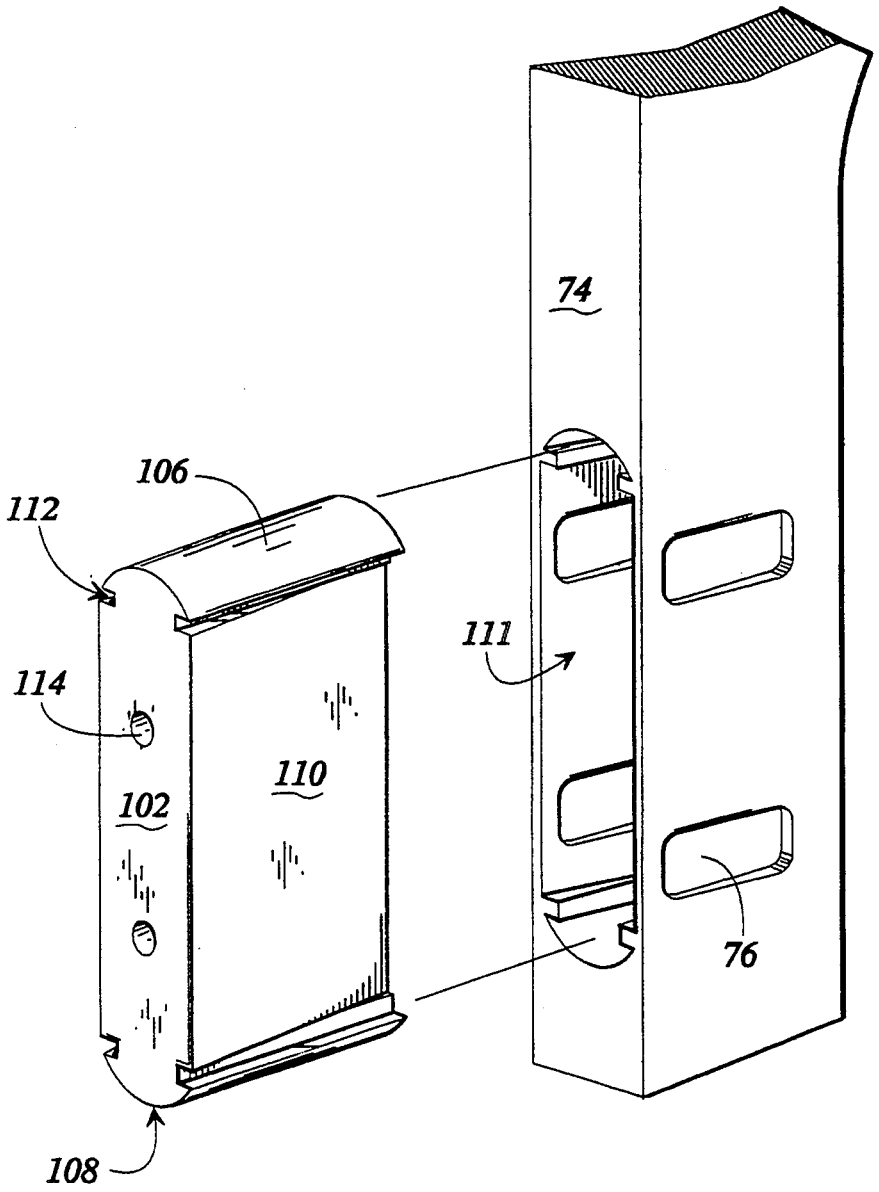
FIG. 20 is a perspective view of the alignment element (wedge insert-pads not shown) disclosed in FIG. 15.

To use the grooved wedge insert 100, the yoke 54 or modified yoke 72 described above may be adapted. The modified yoke arms 74 have oblong holes 76 described above for receiving the wear pads 78, but the recess made for the wedge insert 84 described above must be altered to fit the grooved wedge insert 100. An alternate recess 111 for use with the grooved wedge insert 100 is shaped to fit the wedge insert 100 described above as shown in FIG. 20. The shape of the grooved wedge insert 100 further eliminates any twisting movement of the wedge while it is spring loaded to the modified yoke arm 74 having the alternative recess 111.

Like the wedge insert 84 described above, the grooved wedge insert 100 is spring-loaded to the modified yoke arm 74. The spring loaded bolts 96 are inserted in bolt holes 114 and secure the grooved wedge insert 100 within the alternate recess 111 to the modified yoke arm 74. The spring-loaded bolts 96 exert a radially inward force on the grooved wedge insert 100. This force is partially transferred to the wear pads 78 by virtue of the side surfaces 110 of the grooved wedge insert 100 in the form of outward axial pressure. The outward axial pressure on the wear pads 78 is transferred to the guide plate faces 37 to maintain axial alignment of the upper rotary head 12.

It is noted that the preferred material of the plug 78, like the alignment element 60, is a self-lubricating material, and most preferably self-lubricating plastic. Self-lubricating plastic may be easily manufactured by an injection molding process. Other self-lubricating materials including carbon, carbide and birch wood may also be used as well as other material having inherent lubricating properties.

It will be appreciated that the embodiments discussed above are the preferred embodiments, and that various alternative embodiments are contemplated, falling within the scope of the appended claims. For example, while the majority of the detailed description has focused primarily on the applicability of the present invention to upper rotary head assemblies, it is contemplated that the present invention is equally applicable to lower head assemblies. Furthermore, it is contemplated that the present invention is not limited to cardboard formation applications and may apply to other types of machinery requiring axial alignment. Moreover, while the invention has focused, in part, on tapered guide plates and tapered wear surfaces, other mating profile shapes are contemplated.

It should be understood that the foregoing relates only to preferred embodiments of the present invention and that numerous modifications or alterations may be made therein without departing from the spirit and the scope of the invention as set forth in the appended claims.

We claim:

1. A rotary head assembly comprising:

a rotary head mounted on a rotatable shalt at a predetermined location; and an axial alignment assembly comprising:

a pair of spaced apart guide plates, each guide plate having a surface in opposing face to face relation with the other guide plate, the guide plates being mounted on the shaft fixed to the rotary head, the opposing surfaces of the guide plates extending radially from the shaft;

carrier means with yoke attached thereto, which carrier means locates the yoke in a predetermined axial position; and alignment clement spring-loaded to the yoke, the alignment element having a pair of opposing wear surfaces for contact with the opposing surfaces of the guide plates, the surfaces of wear surfaces and guide plates having mating profiles, and the alignment element having axial pressure means for exerting continuous axial pressure on each wear surface in a direction toward the corresponding guide plate surface, so that there is contact between the opposing surface of the guide plate and the corresponding wear surface.

2. The rotary, head assembly of claim 1 wherein the wear surfaces are made of a self-lubricating material.

3. The rotary head assembly of claim 1 wherein the wear surfaces are made of self-lubricating plastic.

4. The rotary head assembly of claim 1 wherein the opposing guide plate means surfaces taper outwardly away from the shaft.

5. The rotary head assembly of claim 1 wherein the alignment element comprises a base and a pair of parallel outwardly protruding sections, the opposing wear surfaces mounted on the sections in the face to face relation.

6. A rotary head assembly comprising:

a rotary head mounted on a rotatable shaft at a predetermined location; and an axial alignment assembly comprising:

first and second spaced apart guide plates coaxial mounted on the shaft, the guide plates fixed to the rotary head, each guide plate having a face in opposing, spaced apart relation to the other guide plate face:

carrier means with yoke attached thereto, which carrier means locates the yoke in a predetermined axial position;

an alignment clement attached to the yoke and extending between the spaced apart guide plates, the alignment element having a pair of outwardly, radially extending sections positioned between the opposing faces of the guide plates, each section having a wear surface for contact with the corresponding guide plate face; and a spring-loaded bolt securing the alignment element to the yoke for exerting continuous pressure on each wear surface in an outward axial direction toward the corresponding guide plate face.

7. The device of claim 6 wherein the wear surfaces are made of a self-lubricating material.

8. The rotary head assembly of claim 6 wherein the wear surfaces are made of self-lubricating plastic.

9. The rotary head assembly of claim 6 wherein the guide plate faces and wear surfaces having mating profiles.

10. The rotary head assembly of claim 9 wherein the profiles of the guide plate faces and wear surfaces are angled.

11. A rotary head assembly comprising:

a rotary head mounted on a rotatable shaft at a predetermined location; and an axial alignment assembly comprising:

first and second spaced apart guide plates coaxial mounted on the shaft and fixed to one end of the rotary head, the guide plates extending radially from the shaft for a predetermined distance, each having a face in opposing spaced apart relation to the face of the other guide plate;

a spacer of a predetermined thickness, mounted on the shaft between the first and second guide plates, the spacer extending radially from the shaft a distance less than that of the plates;

a yoke mounted to a carrier means for locating the yoke in a predetermined axial position, the yoke having a base and a pair of spaced apart arms extending outwardly from tile base, the arms in spaced relationship with a portion of the guide plate faces, the arms having a thickness less than that of the spacer;

opposing wear surfaces, each wear surface comprising a wear insert held within a similarly shaped recess in the arm of the yoke, and each wear insert comprising a first flat end and second angled end, the opposing surfaces being mounted to the arm and each wear insert in contact with the opposing guide plate face; and axial pressure means comprising:

a wedge insert having opposed converging, angled surfaces, the angled surfaces of the wedge insert are angled at the same degree as the second angled end of tile wear insert, a recess within the yoke for receipt of the wedge insert, and a spring loaded fastener for fastening the wedge insert within the recess to the yoke, for exerting continuous axial pressure on each wear surface in a direction toward the corresponding guide plate face so that axial pressure is thus transferred to the corresponding guide plate face to maintain axial alignment of the rotary head.

12. The rotary head assembly of claim 11 wherein the insert is oblong in cross-section.

13. The rotary head assembly of claim 11 wherein the guide plate faces and wear surfaces have mating profiles.

14. The rotary head assembly of claim 11 wherein the wear surfaces are made of self-lubricating material.

15. The rotary head assembly of claim 11 wherein the wear surfaces are made of self-lubricating plastic.

16. In a rotary head assembly, having a rotary head mounted on a rotatable shaft at a predetermined position, and an axial alignment assembly comprising guide plate means coaxial mounted to the shaft and fixed to one end of the rotary head, the guide plate means having a pair of opposing surfaces extending radially from the shaft, carrier means with yoke attached thereto which locates the yoke in a predetermined position, the improvement comprising:

an alignment element secured to the yoke, the alignment element comprising:

opposing wear surfaces comprising wear pads held within similarly sized holes in the yoke, the wear pads having a first angled end, and a second flat end for contact with the opposing surfaces of the guide plate means; and axial pressure exerting means comprising a wedge insert for receipt into a suitable sized recess within the yoke, the wedge insert having opposed, converging angled surfaces for mating relation with the first angled ends of the wear pads, the wedge insert being secured to the yoke by a spring-loaded fastener mounted to the yoke in a direction radially inward to the shaft, for exerting continuous axial pressure on the wear pads in a direction toward the corresponding opposing surfaces of the guide plate means, so that the wear pads engage in face to face contact with the opposing surfaces of the guide plate means.

17. The improvement of claim 16 wherein the wear surfaces are made of self-lubricating material.

18. The improvement of claim 17 wherein the wear surfaces are made of a self-lubricating plastic.

19. In a rotary head assembly having a rotary head mounted on a first rotatable shaft; and an axial alignment assembly comprising first and second spaced apart guide plates, the plates coaxial mounted on the shaft and fixed to one end of the rotary head, each guide plate having a face in opposing spaced apart relation to the other guide plate, the improvement comprising:

carrier means with yoke attached thereto, the yoke having arms extending between the spaced-apart guide plates in space relation with the opposing faces of the guide plates;

alignment element having a pair of opposing wear surfaces, each wear surface comprising a wear insert having a first flat flat end for contact with the corresponding face of the guide plate and a second angled end, the wear insert held within a corresponding hole in the arm of the yoke; and axial pressure exerting means comprising:

a wedge having a pair of opposed, converging surfaces, the surfaces are in mating contact with the second angled end of the wear insert, and a corresponding wedge-shaped recess for receipt of the wedge, the wedge is pressure mounted to the arm in a radial direction relative to the shaft for exerting continuous axial pressure on the wear insert, so that there is contact between wear inserts and the corresponding faces of the guide plates.

20. The improvement of claim 19 wherein the wear insert is oblong in cross-section.

21. A method for axial aligning a rotary head assembly, comprising the following steps:

positioning a yoke between a pair of spaced apart guide plates, the yoke attached to a carrier mounted on a first shaft and located in a predetermined axial position, the guide plates being coaxial mounted and fixed to a rotary head, the rotary head being mounted on a second rotatable shaft, each guide plate having a face in opposing spaced apart relation to the face of the other guide plate, the yoke having an outwardly extending arm, the arm having a thickness less than that of the distance between the guide plates, the arm extending between the opposing faces of the guide plates;

attaching an alignment element to the arm of the yoke, the alignment element comprising a device having a pair of opposed, converging, angled sections with a central groove therebetween, the angled sections converge towards a central groove, the alignment element having a pair of opposing wear surfaces, the wear surfaces being mounted to the sections, the opposing wear surfaces in lace to face relation with the opposing faces of the guide plates; and exerting continuous axial pressure on each wear surface in a direction toward the corresponding face of the guide plate so that the wear surface contacts the corresponding face of the guide plate and axial alignment of the rotary head is maintained.

22. The method of claim 21 wherein the faces of the guide plates and the wear surfaces have mating profiles.

23. The method of claim 22 wherein the guide plates and wear surfaces are tapered.

24. A method for axial aligning a rotary head assembly, comprising the following steps:

positioning a yoke between a pair of spaced apart guide plates, the yoke attached to a carrier mounted on a first shalt and located in a predetermined axial position, the guide plates being coaxial mounted and fixed to a rotary head, the rotary head being mounted on a second rotatable shaft, each guide plate having a face in opposing spaced apart relation to the face of the other guide plate, the yoke having an outwardly extending arm, the arm having a thickness less than that of the distance between the guide plates, the arm extending between the opposing faces of the guide plates;

attaching an alignment element to the arm of the yoke, the alignment element having a pair of opposing wear surfaces comprising wear pads having a longitudinal axis and first and second ends, the first end being non-perpendicular to the longitudinal axis and the second end being perpendicular to the longitudinal axis, the wear pads held within similarly shaped holes in the yoke, the opposing wear pad in face to face relation with opposing face of the guide plate; and inserting a wedge having a pair of opposed, converging angled surfaces, the surfaces converge outwardly radially relative to the shaft, the angled surfaces correspond with the first angled end of the wear pads, into a corresponding wedge-shaped recess within the yoke, and pressure mounting the wedge to the yoke, so that the wear pad contacts the corresponding face of the guide plate and axial alignment of the rotary head is maintained.

* * * * *